US006455776B1

(12) United States Patent
Milne

(10) Patent No.: US 6,455,776 B1
(45) Date of Patent: Sep. 24, 2002

(54) WIRE MANAGEMENT GROMMET

(75) Inventor: Peter Milne, London (GB)

(73) Assignee: Peter Milne Furniture Makers Ltd., London (GB)

( * ) Notice: Subject to any disclaimer, the term of this patent is extended or adjusted under 35 U.S.C. 154(b) by 0 days.

(21) Appl. No.: 09/400,957

(22) Filed: Sep. 22, 1999

(30) Foreign Application Priority Data

Sep. 23, 1998 (GB) ..... 9820766

(51) Int. Cl.[7] ..... H02G 3/18

(52) U.S. Cl. ..... 174/65 R; 174/48; 174/55; 174/153 G; 312/223.6; 439/535

(58) Field of Search ..... 174/48, 49, 53, 174/54, 55, 65 R, 65 G, 153 G; 16/2.1, 260; 108/64, 150, 160; 220/242; 312/194, 223.6; 439/535

(56) References Cited

U.S. PATENT DOCUMENTS 3,701,837 A * 10/1972 Fork ..... 174/50
3,783,175 A * 1/1974 Timmons ..... 174/48
5,429,431 A * 7/1995 Olson et al. ..... 312/223.6
5,686,700 A * 11/1997 Carpinella ..... 174/65 R
5,765,932 A * 6/1998 Domina et al. ..... 312/223.6
5,860,713 A * 1/1999 Richardson ..... 312/223.6
6,018,126 A * 1/2000 Castellani et al. ..... 174/48
6,024,599 A * 2/2000 Stathis et al. ..... 439/535
6,143,982 A * 11/2000 Gretz ..... 174/65 R
6,150,608 A * 11/2000 Wambeke et al. ..... 174/65 G
6,241,329 B1 * 6/2001 Nielsen ..... 312/107
6,254,427 B1 * 7/2001 Stathis ..... 439/535

FOREIGN PATENT DOCUMENTS

EP 0 487 363 5/1992

* cited by examiner

*Primary Examiner*—Dean A. Reichard
*Assistant Examiner*—Adolfo Nino
(74) *Attorney, Agent, or Firm*—Collard & Roe, P.C.

(57) ABSTRACT

A wire management grommet has a plate which is removably supported by support means in an aperture of a work top so that it can be at least partially rotated about an axis defined by the support means out of a plane of the work top and removed and replaced in an inverted operative position in which bevelled side walls of the aperture and plate respectively define substantially parallel side walls of wire receiving channels.

9 Claims, 5 Drawing Sheets

WIRE MANAGEMENT GROMMET

CROSS REFERENCE TO RELATED APPLICATIONS

The present invention claims the benefit of U.S. Provisional Application No. 60/214,598 filed Jun. 27, 2000. This application is related to U.S. Patent Application No. 09/870,341, filed the same date as this application entitled "ERASABLE PROGRAMMABLE READ ONLY MEMORY (EPROM) CELL STRUCTURES HAVING DRAIN SIDE PROGRAMMING AND ERASE AND METHODS FOR FORMING SAME" by Ratnam which is incorporated by reference in its entirety for all purposes.

BACKGROUND OF THE INVENTION

1. Field of the Invention

The present invention relates to the management of wires and on work tops.

The term wire is intended to embrace all manner of cables, wires and flexes as used for telecommunications and electricity supply.

2. The Prior Art

On desks, side boards, conference tables and other surfaces which are used to support electrical equipment, the disposition of the wires always presents a problem. Typically the wires of computers, telephones and other office equipment will become draped over the edges of the surface using up valuable workspace in their passage from the equipment to the electricity supply socket. The wires can also present trip hazards.

Various wire management systems have been provided. Some systems route wires through an aperture into a leg of the desk. The aperture is typically closed by a plastics plate. Such a plate may slide or be capable of being levered off. It is usually necessary to install the wires carefully and fit a closure plate to cover the exposed portion of the aperture.

These systems suffer from various problems including limited capacity, difficulty of use and being prone to loss of components when wires have to be removed and relocated. The plates are normally thin and easily broken.

Moreover such plastics fittings are unsightly and inappropriate for use in quality cabinet made furniture as in a boardroom environment.

SUMMARY OF THE INVENTION

In accordance with the present invention there is provided a wire management grommet for a work top having upper and lower surfaces, comprising:

means defining an aperture opening into the upper surface of the work top with a smaller opening than at the lower surface and having a bevelled side wall, a removable plate having a first surface sized to correspond to the smaller opening and having a bevelled side wall tapering to a smaller second surface; and support means for supporting the plate within the aperture either in a sealing position with a first surface flush with the upper surface or in an inverted operative position exposing wire receiving channels between the upper and lower surface.

The profile of the aperture and plate may be circular, oval, polygonal or irregular to provide for different aesthetic appearances.

The support means can comprise two arms, preferably three arms which define at least one axis about which the plate can at least partially rotate within the aperture out of the plane of the work top.

Preferably each arm has a recess in order to engage with an edge of the first surface of the plate when in the inverted operative position in order to provide a secure seating for the plate.

The grommet is simple to use and when not in use presents an aesthetic appearance. Such a grommet can easily be let into high quality furniture. When in use it is possible to accommodate several wires without mutual interference. Since the plate can be removed entirely from the aperture it is easy to install and remove the wires when the equipment in use is changed.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DESCRIPTION OF PREFERRED EMBODIMENT

Figure 1:
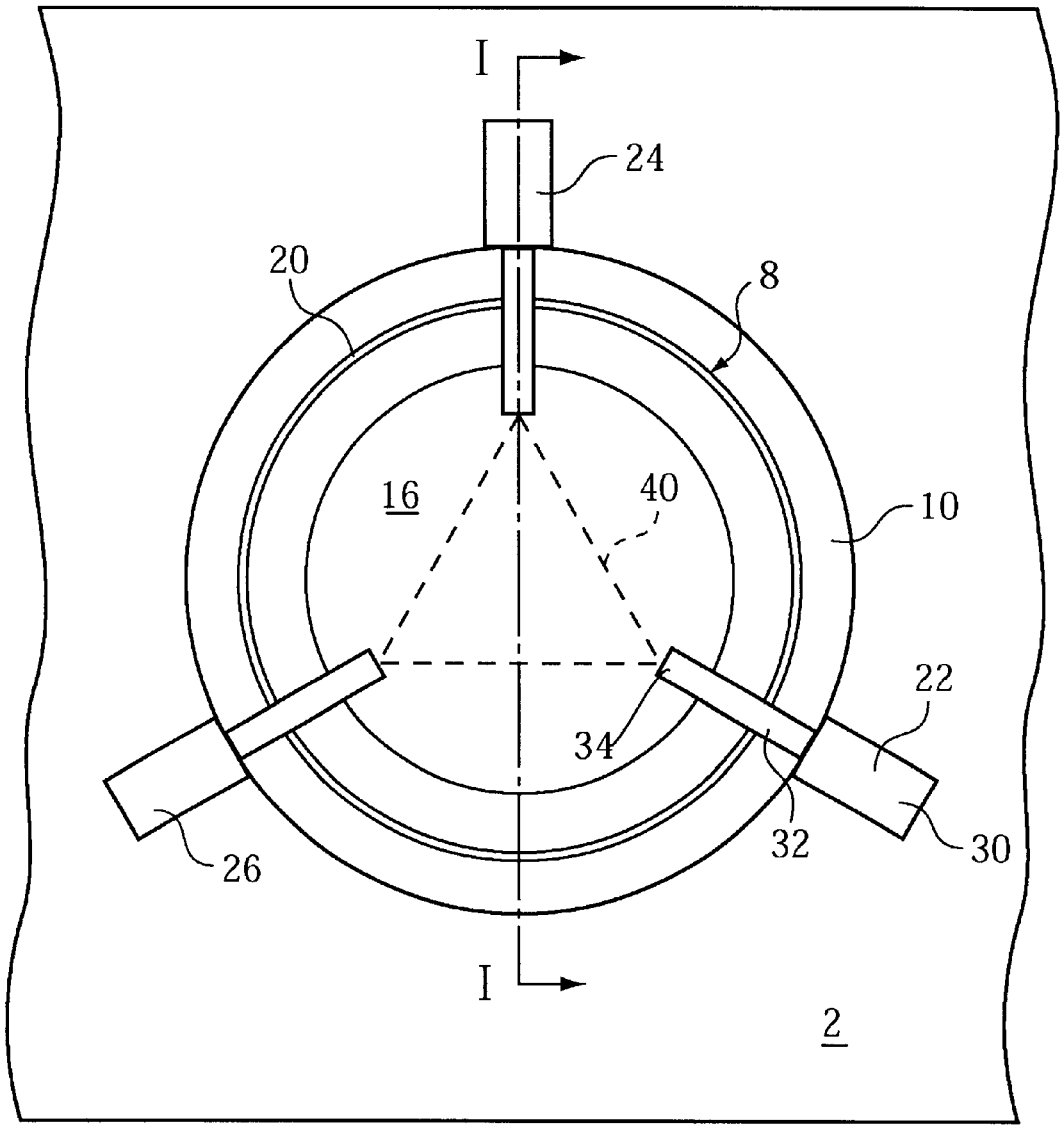
FIG. 1 shows a plan view from below of the grommet in a sealed position.

A wire management grommet as illustrate is intended to be let into a work top 2 of a piece of furniture that is intended to support electrical equipment. The work top 2 may be part of a desk, cupboard or table. The work top 2 has a separated upper surface 4 and a lower surface 6. The grommet is not appropriate for use with laminar work tops such as sheet metal work tops as a certain depth is required between the two surfaces 4, 6.

An aperture 8 is cut into the work top and has a bevelled side wall 10 which tapers from a larger opening in the lower surface towards a smaller opening in the upper surface 4. In the embodiment illustrated the aperture 8 is circular. Although this is one of the simplest configurations to construct and use, it will be appreciated that apertures of various other shapes such as ovals and polygons or irregular shapes may be used.

Figure 2:
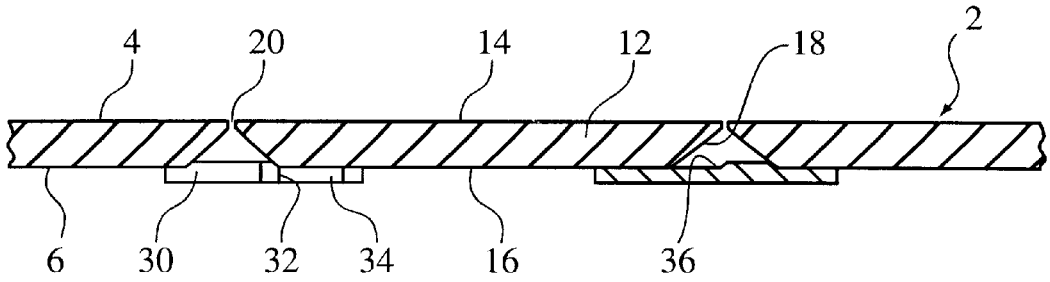
FIG. 2 shows a section on the line A—A in FIG. 1.
Figure 3:
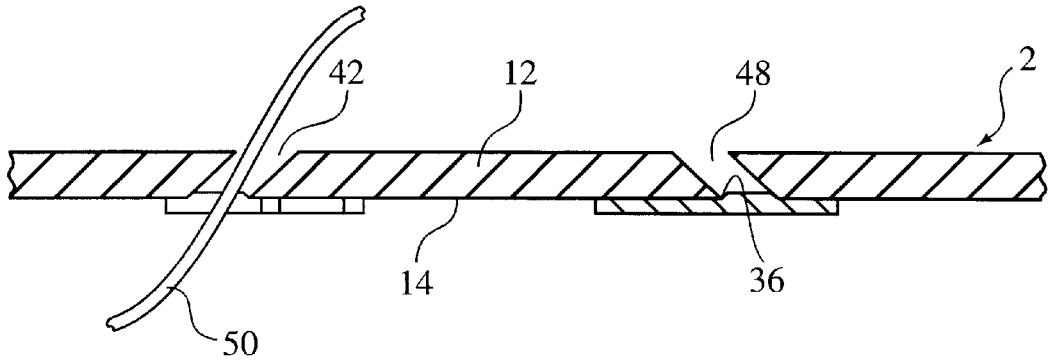
FIG. 3 shows a section on the line A—A with the grommet inverted into its operative position.
Figure 4:
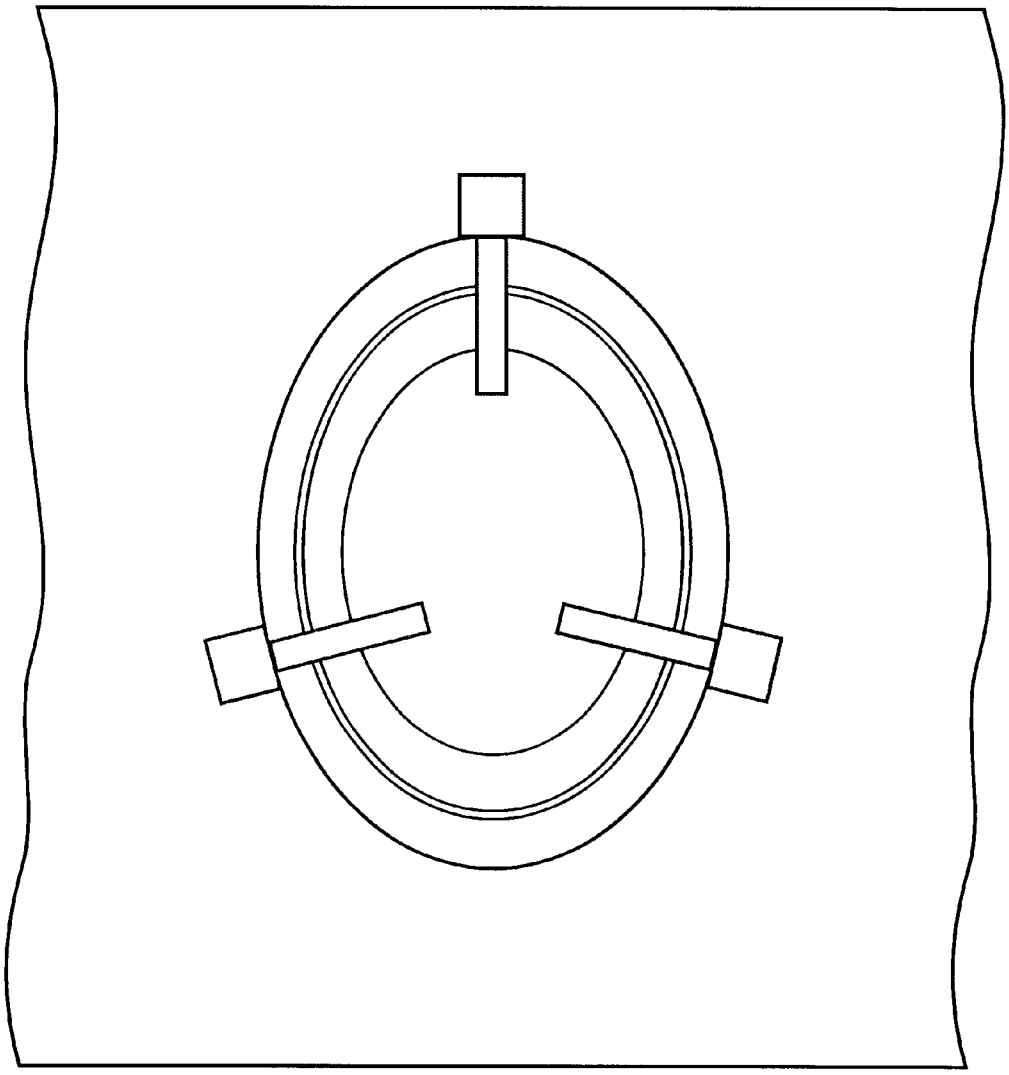
FIG. 4 shows a plan view from below of an additional embodiment of the grommet having an oval plate in a sealed position.
Figure 5:
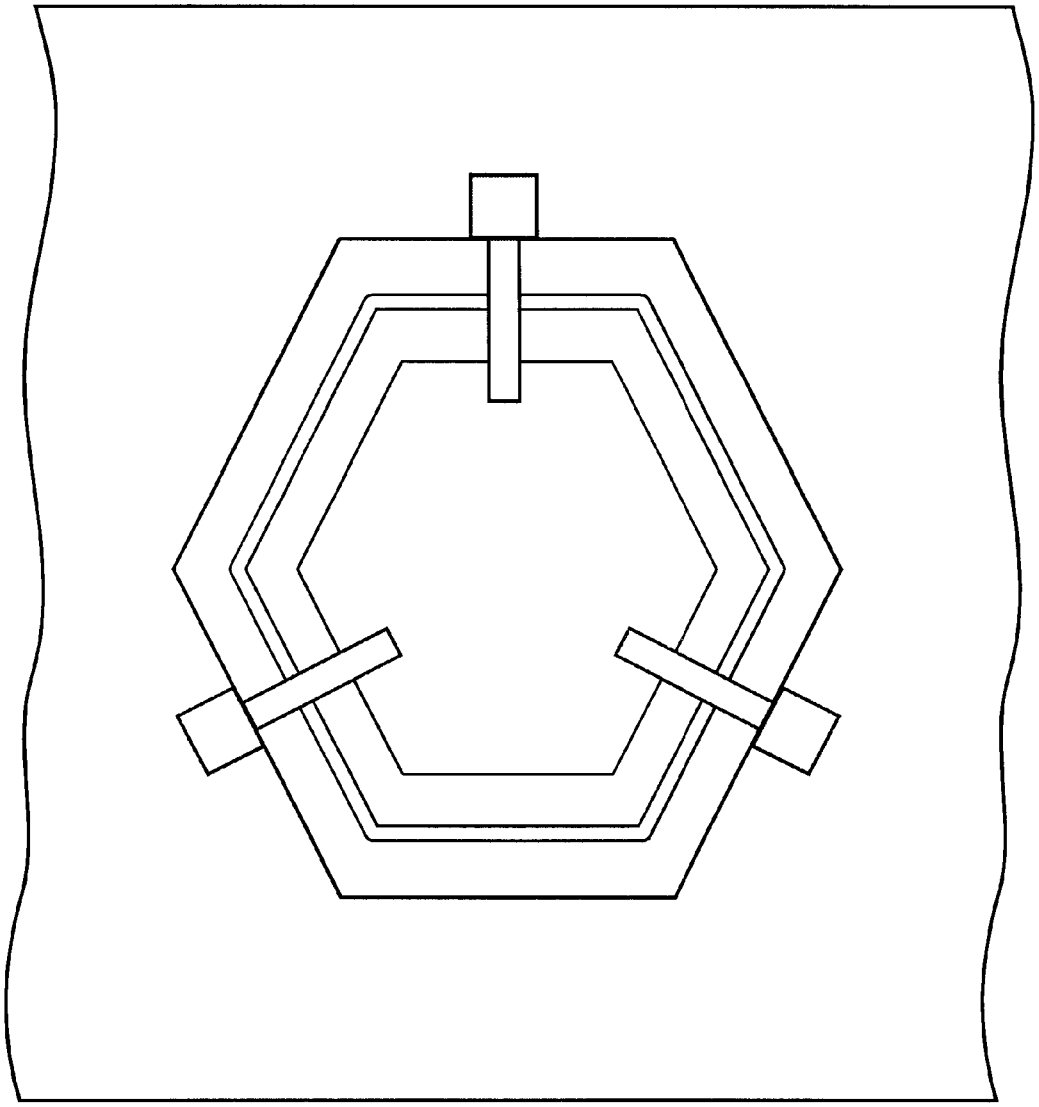
FIG. 5 shows a plan view from below of an another embodiment of the grommet having a polygonal plate in a sealed position.
Figure 6:
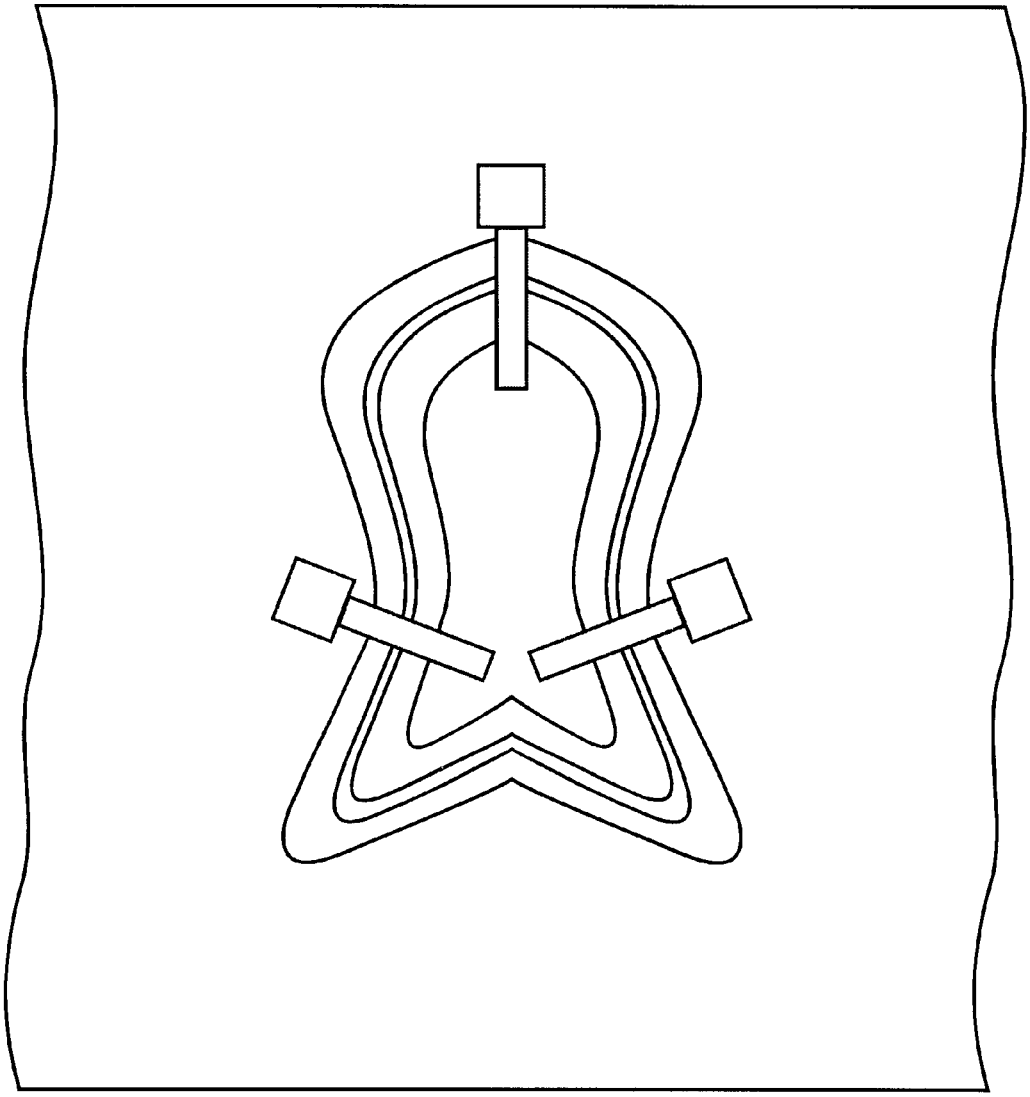

A removable plate 12 fits into the aperture 8. The plate 12 is of substantially the same depth as the work top and has first and second surfaces 14 and 16 and a bevelled side wall 18 joining the two surfaces. In a sealed position as shown in FIGS. 1 and 2 with the first surface uppermost, the plate 12 seals the aperture 8 from above and the upper surface 4 and the first surface 14 are flush with one another. A narrow gap 20 is formed in the upper surface of the work top where the first surface of the plate 12 adjoins the remainder of the upper surface 4 of the work top. This gap 20 may be as narrow as 0.5 mm. The side wall 18 of the plate is bevelled at a similar angle to the bevel of the side wall 10 of the aperture and tapers from the larger first surface 14 to the smaller second surface 16. The angle of bevel of the side walls is typically 45°.

The plate 12 is supported in its sealed position by support means which define at least one pivoting axis about which the plate can at least partially rotate within the aperture 8.

As illustrated in the present embodiment a three point support means is provided by arms 22, 24 and 26 which are secured to the lower surface 6 of the work top adjacent the aperture 8 at respective apices of an equilateral triangle. Each arm is of similar construction and comprises a fixing portion 30 secured to the lower surface 6 of the work top, a bridging section 32 which extends across the space to the adjacent surface of the plate and a seating portion 34 which supports the plate 12 in use. The seating portion has a recess 36 towards its remote end in order to provide locating means for an edge of the first surface 14 when the plate 12 is in its operative position as shown in FIG. 2. The plate 12 is located in its sealing position by the close fit between the first surface 14 and the upper surface 4 of the work top.

In the illustrated embodiment rotation axises 40 are defined between each pair of arms which allow the plate to be flipped up from its sealing position and replaced in an inverted operative position in the aperture. The rotation of the plate 12 can readily be initiated by depressing the plate near its edge between any two arms. This causes the plate to lift out of the surface of the work top so that it can be removed and subsequently replaced in its inverted operative position. In the operative position wire receiving channels 42 are formed between the now substantially parallel facing side walls 10, 18 of the aperture 8 and plate 12 between each pair of arms. These provide sufficient space for several wires 50.

In order to remove the plate when in its operative position it is once again depressed from the upper surface of the work top adjacent an edge opposite the channel in which the wire or wires are located.

The wires and even bulky plugs can easily be passed through the aperture when the plate is removed and the wires will naturally accommodate themselves in the channels when the plate is replaced. When the plate is in its operative position an open annular gap 48 is exposed in the upper surface of the work top. Since the second surface 16 of the plate can be finished in the same manner as the upper surface 14 of the work top, this results in a neat and pleasing aesthetic appearance.

It will be appreciated that grommets as described can be formed in various sizes. A practical minimum size is approximately 70 mm for a work top depth of between 10 and 20 mm. A size of 150 mm allows the comfortable accommodation of four or more wires.

The support means may have various alternative configurations. For example two arms could be used provided the seating portion of each had sufficient breadth to maintain the plate in a stable position flush with the upper surface of the work top. A three point support means prevents any wobble and allows whole of the work top to be used as if the grommet were not present.

The plate and aperture can easily be manufactured in a single operation by using a CNC router to cut a triangular groove of the required profile from a lower surface of a work top.

The support means can be formed as a plastics injection moulded component. Preferably the three arms 22, 24 and 26 are connected together by a ring member that can be secured to the lower surface of the work top by means of screws or adhesive.

The grommet as described may be used with work tops of varying materials such as wood, MDF, fibre board or plastics foams.

What is claimed is:

1. A wire management grommet for a work top comprising:

an upper surface;

a lower surface;

a beveled side wall coupling said upper surface to said lower surface;

wherein said upper surface, said lower surface, and said beveled side wall define an aperture opening into the upper surface of the work top with the upper surface having a smaller opening than the lower surface;

a removable plate having a first surface sized to correspond to the smaller opening in said upper surface, said removable plate having a beveled side wall tapering to a smaller second surface; and a support for supporting said removable plate within said aperture either in a sealing position with a first surface flush with said upper surface or in an inverted operative position exposing a plurality of wire receiving channels between said upper and said lower surface.

2. A grommet as claimed in claim 1, wherein said support defines at least one axis about which the plate can at least partially rotate within the aperture.

3. A grommet as claimed in claim 1, wherein a profile of the aperture and plate is circular.

4. A grommet as claimed in claim 1, wherein a profile of the aperture and plate is oval.

5. A grommet as claimed in claim 1, wherein a profile of the aperture and plate is polygonal.

6. A grommet as claimed in claim 1, wherein a profile of the aperture and plate is irregular.

7. A grommet as claimed in claim 1, wherein said support comprises at least two arms which define at least one axis about which the plate can at least partially rotate within said aperture out of a plane of the work top.

8. A grommet as claimed in claim 7, wherein the support means comprises three arms.

9. A grommet as claimed in claim 7, wherein each arm has a recess, to engage with an edge of said first surface of the plate when in an inverted operative position.

* * * * *